US011530089B2

(12) United States Patent
Martin et al.

(10) Patent No.: US 11,530,089 B2
(45) Date of Patent: Dec. 20, 2022

(54) TRANSPORT CONTAINERS FOR AIR-COOLED HEAT EXCHANGERS

(71) Applicant: Hudson Products Corporation, Ball Ground, GA (US)

(72) Inventors: Indian Martin, Tulsa, OK (US); Chad Martin, Tulsa, OK (US); Ron Kuegler, Tulsa, OK (US); Scott Jarvis, Tulsa, OK (US)

(73) Assignee: Hudson Products Corporation, Ball Ground, GA (US)

( * ) Notice: Subject to any disclaimer, the term of this patent is extended or adjusted under 35 U.S.C. 154(b) by 323 days.

(21) Appl. No.: 16/592,014

(22) Filed: Oct. 3, 2019

(65) Prior Publication Data

US 2020/0109004 A1 Apr. 9, 2020

Related U.S. Application Data

(60) Provisional application No. 62/740,923, filed on Oct. 3, 2018.

(51) Int. Cl.
*B65D 88/12* (2006.01)
*B65D 88/02* (2006.01)
*B65D 90/00* (2006.01)
(Continued)

(52) U.S. Cl.
CPC ..... *B65D 88/12* (2013.01); *B65D 88/027* (2013.01); *B65D 90/0033* (2013.01);
(Continued)

(58) Field of Classification Search
CPC ..... B65D 88/12; B65D 88/027; B65D 88/04; B65D 88/122; B65D 88/00; B65D 90/0033; B65D 90/10; B65D 90/14; F24F 1/0018
(Continued)

(56) References Cited

U.S. PATENT DOCUMENTS 1,667,887 A * 5/1928 Fallert ..... B65D 5/5035 206/320
3,414,121 A * 12/1968 Suzuki ..... B65D 81/113 206/320
4,640,419 A * 2/1987 Yang ..... B65D 71/00 206/499
(Continued)

FOREIGN PATENT DOCUMENTS

DE 19508101 A1 7/1996
FR 2816918 A1 5/2002
(Continued)

OTHER PUBLICATIONS

International Search Report and Written Opinion by the international Search Authority for international Application No. PCT/US2019/054494, dated Dec. 13, 2019 , (15 pages).

*Primary Examiner* — Rafael A Ortiz
(74) *Attorney, Agent, or Firm* — Cook Alex Ltd.

(57) ABSTRACT

A transport container for transporting a hub and vanes of a fan prior to assembly of the fan includes a body having a floor and defining an interior having a top opening. The transport container also includes a lid that removably covers the top opening. A divider wall is positioned within the interior so that the interior is divided into first and second internal compartments that hold the vanes of the fan. A hub post is positioned within the interior of the body. The hub post has a bottom end portion attached to the floor and a top end portion that is inserted into a central opening of the hub of the fan.

6 Claims, 6 Drawing Sheets

(51) Int. Cl.
*B65D 90/10* (2006.01)
*B65D 90/14* (2006.01)
*F24F 1/0018* (2019.01)

(52) U.S. Cl.
CPC ..... *B65D 90/10* (2013.01); *B65D 90/14* (2013.01); *F24F 1/0018* (2013.01)

(58) Field of Classification Search
USPC ..... 206/320, 216, 521, 722–724, 564, 523, 206/586, 587, 591, 592, 223
See application file for complete search history.

(56) References Cited

U.S. PATENT DOCUMENTS 4,953,698 A * 9/1990 Gregorich ..... B65D 85/68 206/319
5,240,378 A * 8/1993 Janisse ..... B65D 85/68 53/472
5,779,045 A * 7/1998 Yu ..... B65D 85/68 206/320
8,556,112 B2 * 10/2013 Tujague, Sr. ..... B65D 19/44 108/26
2004/0149604 A1 * 8/2004 Humphrey ..... B65D 85/68 206/320
2011/0049007 A1 * 3/2011 Liao ..... B65D 81/113 206/723
2013/0081967 A1 * 4/2013 Gaul ..... B65D 5/445 206/386

FOREIGN PATENT DOCUMENTS

JP S61232184 A 10/1986
JP S63258774 A 10/1988

* cited by examiner

TRANSPORT CONTAINERS FOR AIR-COOLED HEAT EXCHANGERS

CLAIM OF PRIORITY

This application claims the benefit of U.S. Provisional Application No. 62/740,923, filed Oct. 3, 2018, the contents of which are hereby incorporated by reference.

FIELD OF THE INVENTION

The present invention generally relates to air-cooled heat exchangers, and more particularly, but not by way of limitation, to an improved system for transporting parts used to assemble an air-cooled heat exchanger.

BACKGROUND OF THE INVENTION

Air-cooled heat exchangers are used in a wide variety of industrial applications. A process fluid, either a gas or a liquid, is passed through a series of cooling tubes while air is mechanically passed over the exterior of the cooling tubes. The air absorbs heat from the cooling tubes, thereby lowering the temperature of the fluid within the tubes. The cooling tubes may include lateral or axial fins to aid in heat transfer.

Air-cooled heat exchangers employ large fans to force or draw air at ambient conditions through a plenum. The plenum directs the ambient air through the cooling tube assembly, which includes header boxes located on opposite sides of the plenum. In some applications, a series of adjustable louvers are positioned downstream and/or upstream from the cooling tubes to control the flow of air across the cooling tube assembly.

The fan is typically driven by an internal or external engine. The fan includes a central hub and a plurality of vanes extending from the hub. The hub is connected to a fan shaft that extends from the fan to a drive assembly. The drive assembly may include a series of intermediate shafts, sheaves and bearings that transfer torque from the engine to the fan shaft and fan. The fan is often constructed from relatively lightweight materials to improve the performance and efficiency of the air-cooled heat exchanger.

The fan is typically shipped from the manufacturer in a disassembled condition. The hub and vanes are often large and special handling is required to safely ship the components without damage. In the past, manufacturers have relied on traditional shipping practices by placing the vanes of the fan in single-use cardboard boxes with protective foam or other cushioned packing materials. The boxes are often palletized and shipped with the hub strapped to the outside of the cardboard boxes.

The existing shipping practices are undesirable for several reasons, including the lack of protection afforded the hub, the requirement for multiple boxes that must be tracked and shipped together, and the waste created by the boxes and protective shipping materials. Accordingly, there is a need for an improved shipping system for transporting the fan and other components of large air-cooled heat exchangers. The presently preferred embodiments are directed to these and other deficiencies in the prior art.

DETAILED DESCRIPTION

Figure 1:
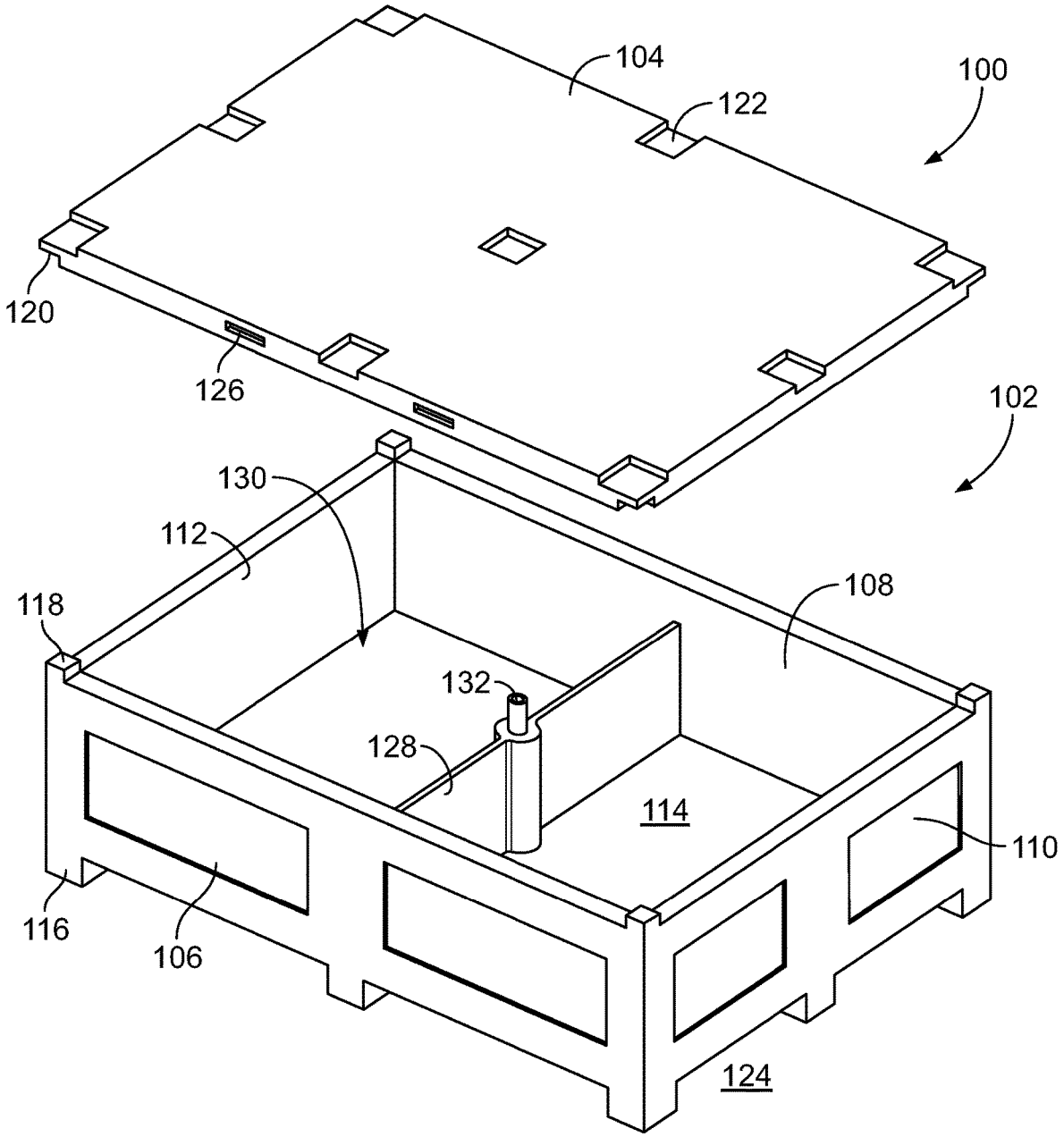
FIG. 1 provides a perspective view of a fan shipping container constructed in accordance with an exemplary embodiment.

Referring to FIGS. 1-5, shown therein are various depictions of a transport container 100 constructed accordance with an exemplary embodiment of the present invention. The transport container 100 is designed to carry various components of an air-cooled heat exchanger, which may include a fan hub 200, fan vanes 202 and assorted parts 204. As is well understood in the art, the fan vanes 202 are configured for attachment to the fan hub 200, which is connected to a drive shaft for rotation by a motor or engine. The fan hub 200 and fan vanes 200 may be constructed from lightweight metal or composite materials.

The transport container 100 generally includes a body 102 and a lid 104. The body 102 has a front 106, back 108, right side 110, left side 112 and floor 114. The lid 104 is sized and configured to rest securely on the top surfaces of the body 102. Unless otherwise indicated, the various parts of the transport container 100 can be constructed from a durable plastic that is resistant to moisture. Suitable materials of construction include high density polyethylene and reinforced acrylonitrile butadiene styrene (ABS) plastics that can be molded, extruded or otherwise formed into the component parts of the transport container 100.

The body 102 includes a plurality of feet 116 that are configured to support the body 102 on a surface or on another transport container 100. The body 102 also includes a plurality of tabs 118 that extend above the upper surface of the front 106, back 108, right side 110 and left side 112. The tabs 118 are configured to be received within corresponding lower recesses 120 on the underside of the lid 104. The engagement between the tabs 118 and the lower recesses 120 help align and secure the lid 104 to the body 102. The lid 104 optionally includes a plurality of upper recesses 122 on the top of the lid 104 that are sized and positioned to receive the feet 116 of a transport container 100 when two transport containers 100 are vertically stacked.

The feet 116 and floor 114 are configured to define fork channels 124 within the body 102. The fork channels 124 are sized and configured to facilitate lifting the transport container 100 with a standard forklift. As noted in FIG. 1, the transport container 100 includes fork channels 124 that are accessible from the front 106, back 108, right side 110 and left side 112. The lid 104 can include strap channels 126 that extend internally through the lid 104. The strap channels 126 permit the use of straps (not shown) for securing the lid 104 to the body 102. The straps can be routed through the strap channels 126, around the body 102 and through the fork channels 124.

Figure 2:
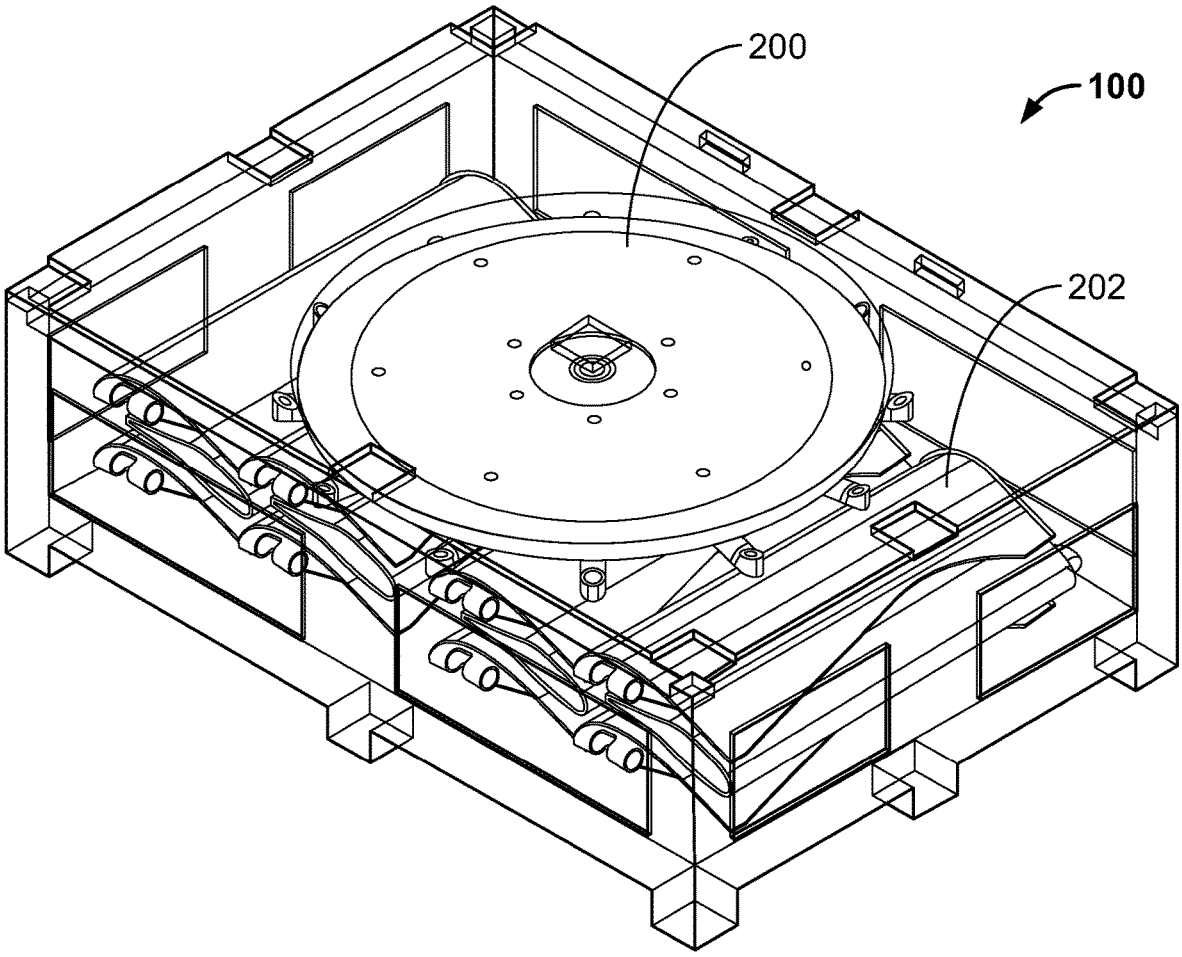
FIG. 2 is a see-through depiction of the shipping container of FIG. 1 illustrating the arrangement of the hub and vanes within the container.
Figure 3:
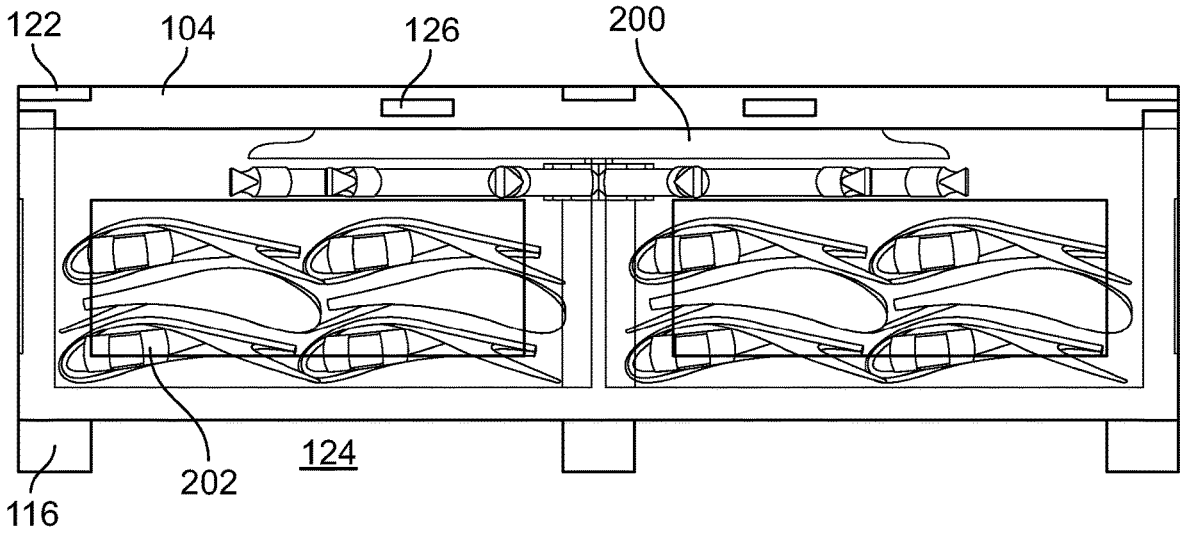
FIG. 3 is a front view of the shipping container of FIG. 2.
Figure 4:
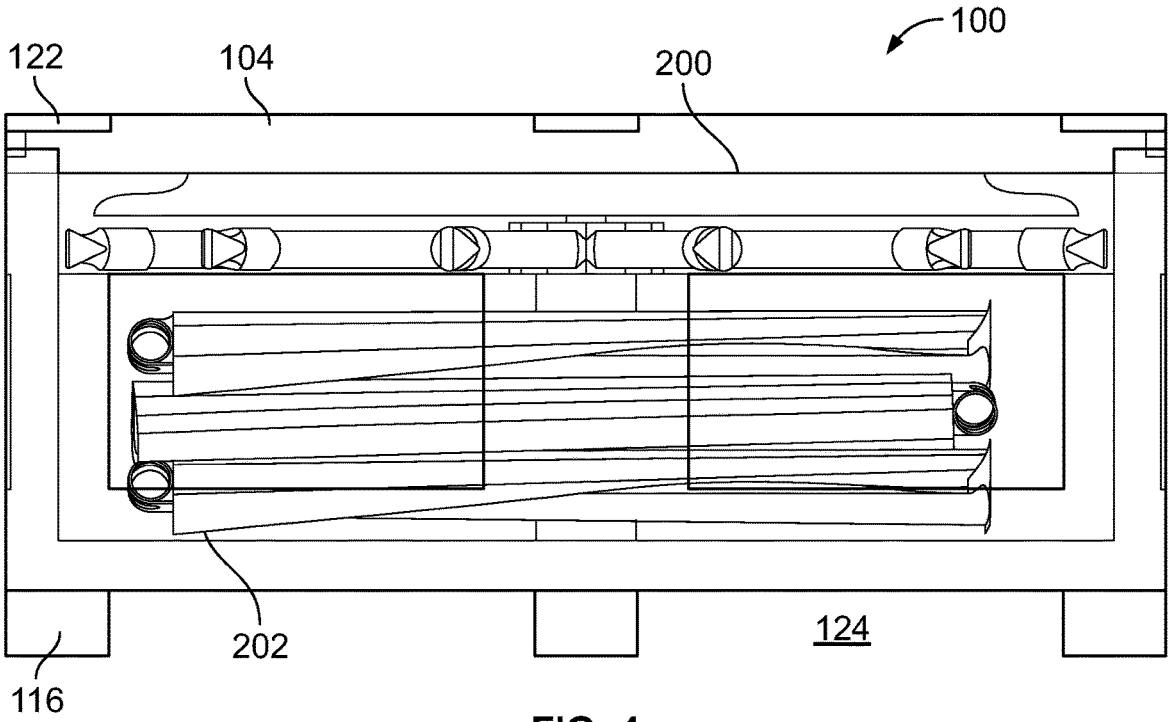
FIG. 4 is a side view of the shipping container of FIG. 2.

In the embodiment depicted in FIG. 1, the body 102 further includes a central divider 128 that extends between the front 106 and back 108. The central divider creates two internal compartments 130 that are sized to contain the fan vanes 200 (as illustrated in FIGS. 2-4). The central divider 128 includes a vertically oriented hub post 132 that has an outer diameter that is substantially the same as the outer diameter of the fan drive shaft so that the hub post 132 can be inserted into the fan hub 200. In this way, the fan hub 200 can be placed onto the hub post 132 to support the fan hub 200 within the transport container 100. Although not depicted in FIGS. 2-4, it will be appreciated that additional internal packing can be used to bolster and support the fan hub 200, fan vanes 202 and other parts 204 within the transport container 100.

Figure 5:
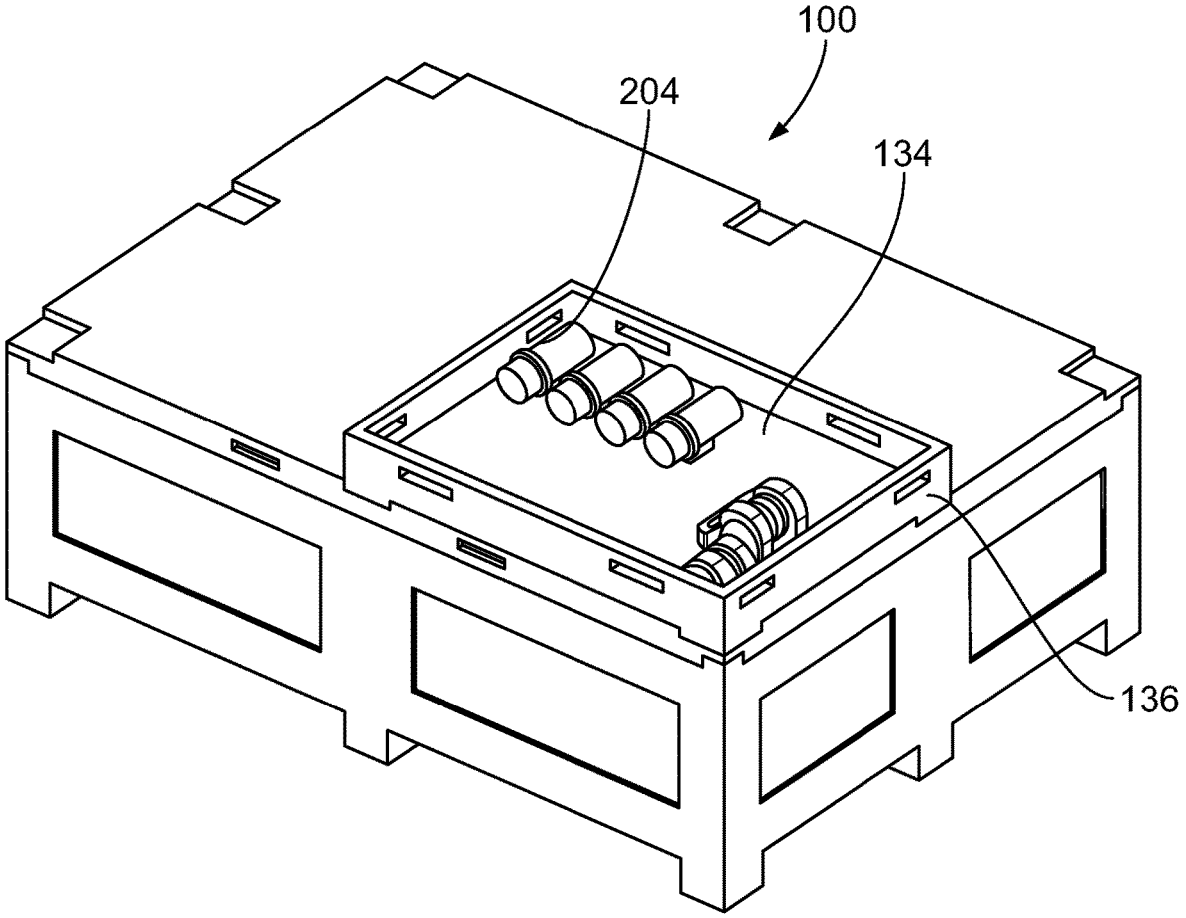
FIG. 5 is a top perspective view of the shipping container of FIG. 1 with an optional parts container.

Turning to FIG. 5, shown therein is a perspective view of the transport container 100 with an optional parts container 134. The parts container 134 is sized to hold various accessories and parts used to assembly the air-cooled heat exchanger. In exemplary embodiments, the parts container 134 includes a plurality of abutments 136 that are sized and configured to be received within the upper recesses 122 of the lid 104. In this way, the parts container 134 can be securely positioned on top of the lid 104.

Figure 6:
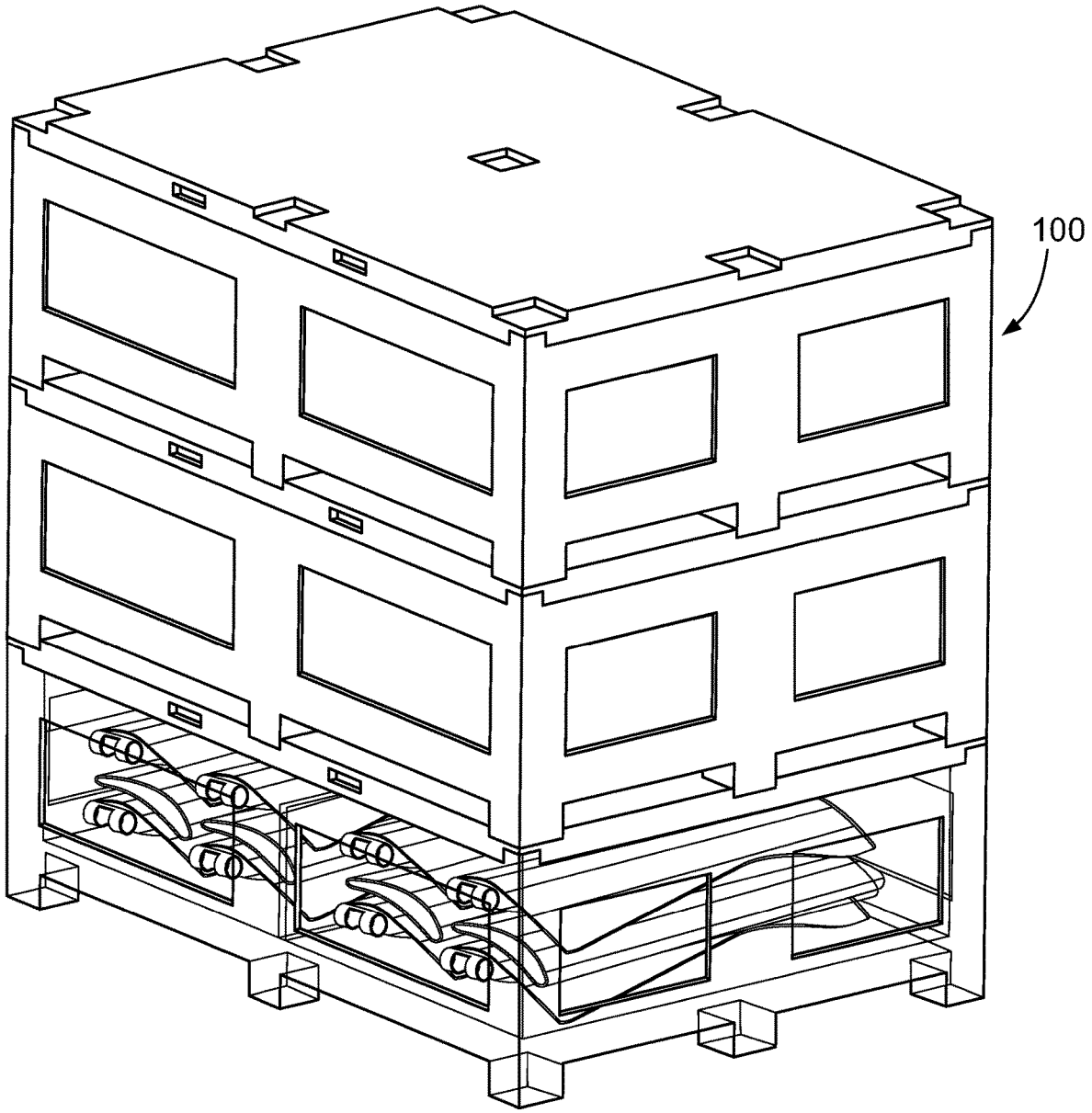
FIG. 6 is a perspective view of three shipping containers arranged in a vertical stack.
Figure 7:
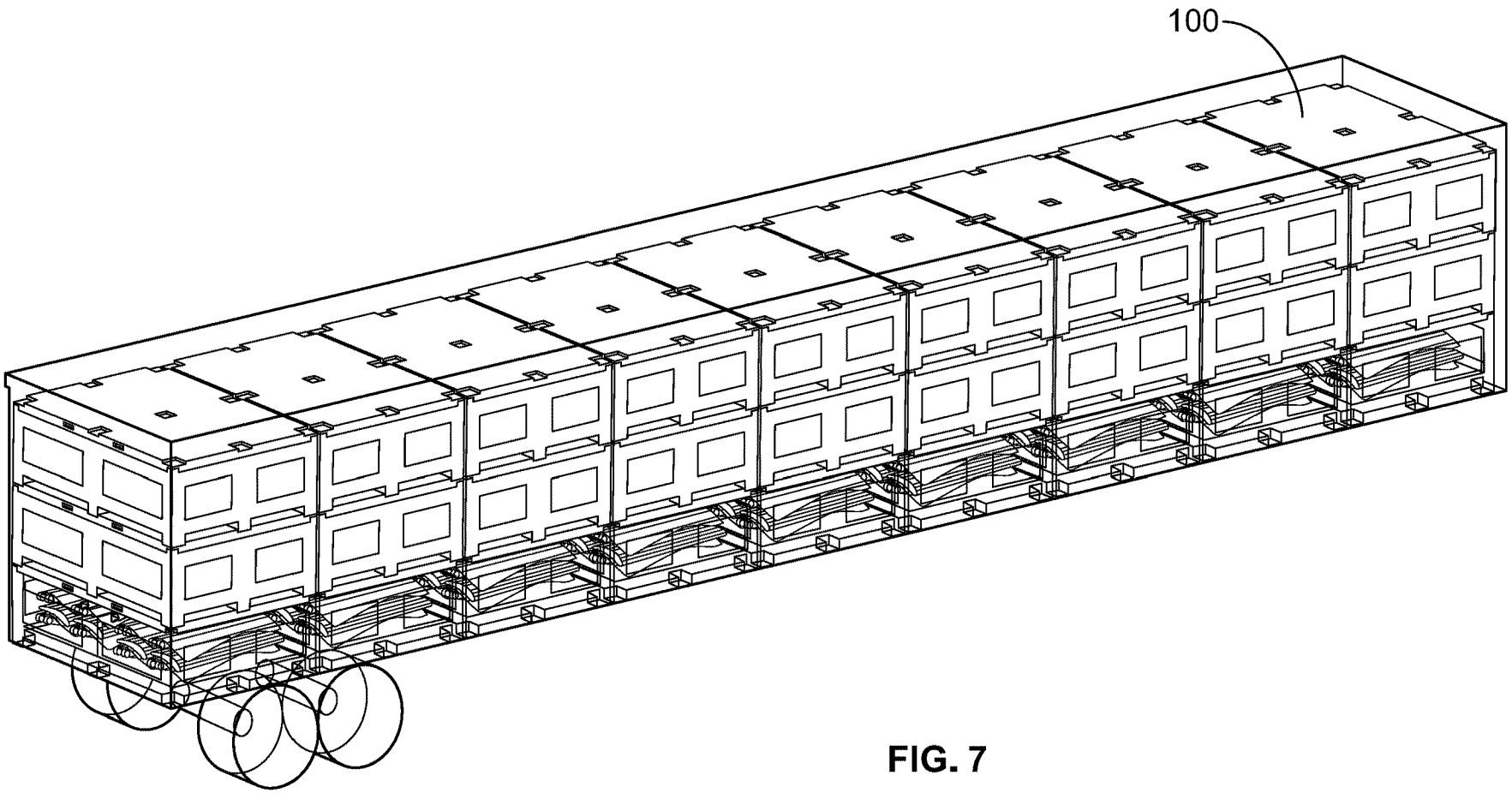
FIG. 7 is a perspective view of a plurality of shipping containers stacked and loaded in a standard semi-tractor trailer.

Turning to FIGS. 6 and 7, shown therein are various depictions of multiple transport containers 100 stacked for storage or shipment. In FIG. 6, three transport containers 100 are vertically stacked. The substantially rigid transport containers 100 are designed to support the weight of multiple fully-loaded transport containers 100. FIG. 7 depicts an exemplary manner in which twenty-seven (27) transport containers 100 have been stacked and loaded into a large commercial trailer for shipment. Although the transport container 100 has been described and illustrated in connection with transport services, it will be appreciated that the transport container 100 can also be used for storing components associated with air-cooled heat exchangers.

The transport container 100 presents a substantial improvement over conventional methods of storing and transporting parts for an air-cooled heat exchanger. The transport container 100 is reusable, durable, weather resistant and suitable for long-term storage of fan components. It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms expressed herein. It will be appreciated by those skilled in the art that the teachings of the present invention can be applied to other systems without departing from the scope and spirit of the present invention.

What is claimed is:

1. A transportable fan component system comprising:
a. a fan hub including a central opening;
b. a plurality of fan vanes configured to be secured to the fan hub;
c. a transport container comprising:
i) a body including first and second opposing sidewalls and a floor and defining an interior having a top opening;
ii) a lid configured to removably cover the top opening;
iii) a divider wall positioned within the interior and extending between the first and second sidewalls so that the interior is divided into first and second internal compartments, said first and second internal compartments holding the plurality of fan vanes;
iv) a hub post positioned within the interior of the body and within a central portion of the divider wall, said central portion of the divider wall flanked by a first divider wall portion extending between the first sidewall and the central portion and a second divider wall portion extending between the second sidewall and the central portion, wherein said first divider wall portion and said second divider wall portion are coplanar, said hub post having a bottom end portion attached to the floor and a top end portion removably inserted into the central opening of the fan hub with a top edge of the divider wall supporting the fan hub with the plurality of fan vanes held within the first and second internal compartments positioned between the fan hub and the floor of the body.

2. The system of claim 1 wherein the bottom end portion of the hub post is attached directly to the floor.

3. The system of claim 1 wherein the lid includes strap channels extending internally through the lid, said strap channels and said body configured to receive straps so that the lid is secured to the body.

4. A transportable fan component system comprising:
a. a fan hub including a central opening;
b. a plurality of fan vanes configured to be secured to the fan hub;
c. a transport container comprising:
i) a body including a floor and defining an interior having a top opening;
ii) a lid configured to removably cover the top opening, said lid including a plurality of upper recesses on a topside of the lid, said plurality of upper recesses sized and spaced to receive and support feet of a second container so that the transport container and the second container may be vertically stacked;
iii) a divider wall positioned within the interior so that the interior is divided into first and second internal compartments, said first and second internal compartments holding the plurality of fan vanes;
iv) a hub post positioned within the interior of the body, said hub post having a bottom end portion attached to the floor and a top end portion removably inserted into the central opening of the fan hub;
v) a plurality of feet connected to the floor and configured to support the body on a surface, said plurality of feet defining fork channels configured to receive forks of a forklift for lifting the transport container.

5. The system of claim 4 further comprising a parts container configured to be received within the interior of the body of the transport container and to hold accessories and parts, said parts container including a plurality of abutments that are configured to be received within the upper recesses of the lid.

6. A transportable fan component system comprising:
a. a fan hub including a central opening;
b. a plurality of fan vanes configured to be secured to the fan hub;
c. a transport container comprising:
i) a body including a floor and defining an interior having a top opening, said body including a plurality of upwardly extending tabs spaced around the top opening;
ii) a lid configured to removably cover the top opening, said lid including a plurality of lower recesses on an underside of the lid that are configured to receive the plurality of upwardly extending tabs when the lid is covering the top opening;
iii) a divider wall positioned within the interior so that the interior is divided into first and second internal compartments, said first and second internal compartments holding the plurality of fan vanes;

iv) a hub post positioned within the interior of the body, said hub post having a bottom end portion attached to the floor and a top end portion removably inserted into the central opening of the fan hub.

* * * * *